United States Patent [19]

Boyer

[11] 4,032,337

[45] June 28, 1977

[54] METHOD AND APPARATUS FOR PRESSURIZING HOT-ISOSTATIC PRESSURE VESSELS

[75] Inventor: Charles B. Boyer, Mount Lebanon, Pa.

[73] Assignee: Crucible Inc., Pittsburgh, Pa.

[22] Filed: July 27, 1976

[21] Appl. No.: 709,062

[52] U.S. Cl. ..... 75/226; 75/214; 65/53; 65/54; 137/563; 425/405 H

[51] Int. Cl.[2] ..... B22F 3/00

[58] Field of Search ..... 65/52, 53, 54; 137/563; 425/78, 405 H; 75/226, 214

[56] References Cited

UNITED STATES PATENTS

| | | | |
|---|---|---|---|
| 3,254,496 | 7/1966 | Roche et al. | 62/54 |
| 3,303,660 | 2/1967 | Berg | 62/54 |
| 3,419,935 | 1/1969 | Pfeiler et al. | 425/405 H |
| 3,562,371 | 2/1971 | Bush | 75/226 |
| 3,624,759 | 11/1971 | Carlson | 137/563 |

OTHER PUBLICATIONS

Johansson, R., "*Isostatic Compaction*" *ASEA Journal* 43 (1970): 6, pp. 115–118.

*Primary Examiner*—Brooks H. Hunt

[57] ABSTRACT

A method and apparatus for the rapid, high-capacity pressurization of hot-isostatic pressing vessels, specifically of the type adapted for the hot-isostatic pressing of alloy shapes from powder metallurgy alloy charges. This is achieved by pressurizing with argon gas which is obtained by pumping cryogenic liquid argon at relatively low pressure to a relatively higher pressure and vaporizing said pumped liquid argon to produce said gas, which gas after use in the vessel for compacting is reclaimed and reliquefied for reuse.

14 Claims, 1 Drawing Figure

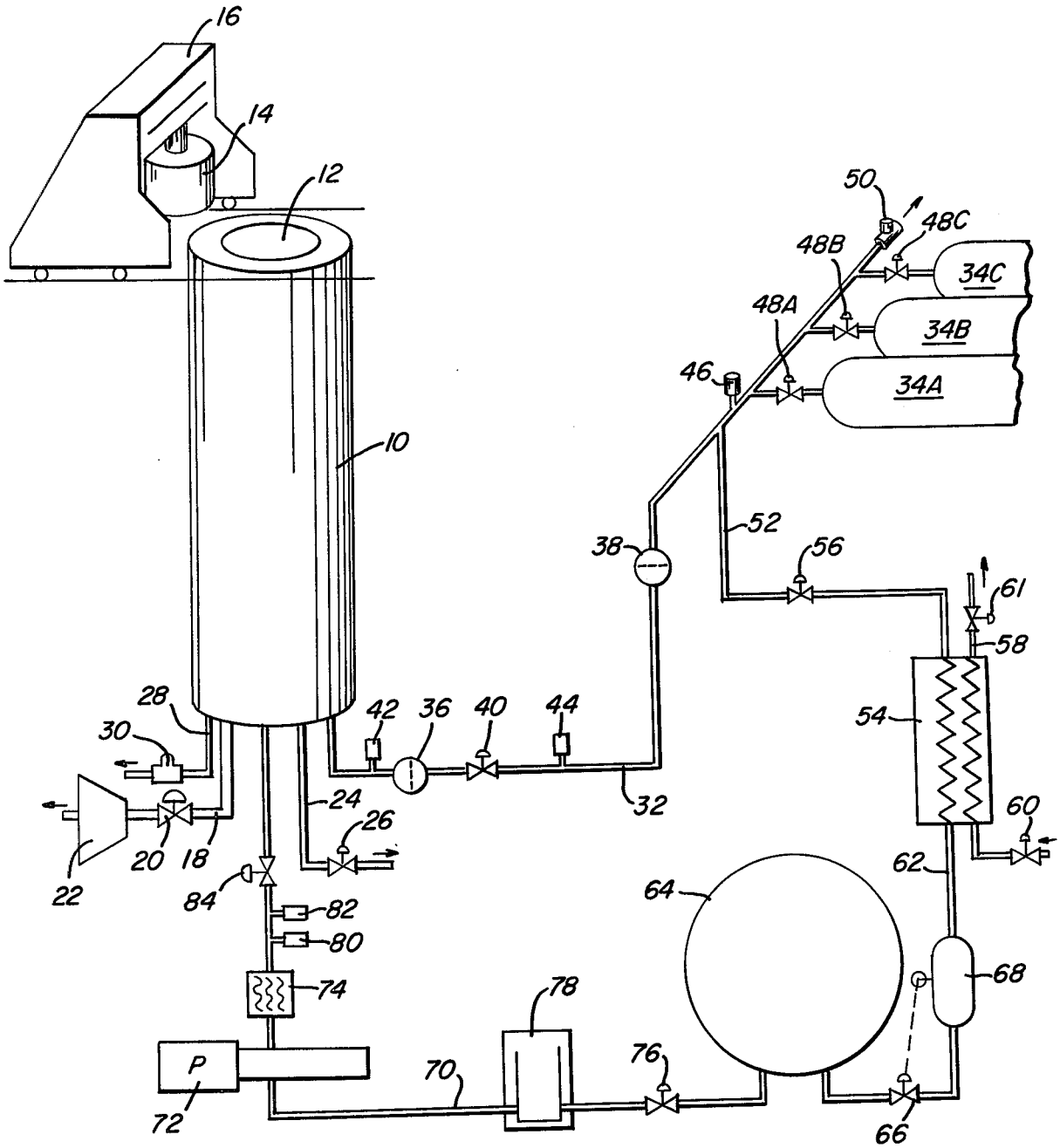
16
14
12
50
48C
48B
34C
48A
34B
46
34A
10
52
38
56
61
58
28
42
36
40
44
54
30
24
32
60
26
20
18
62
22
84
64
82
80
68
74
78
P
70
76
72
66

METHOD AND APPARATUS FOR PRESSURIZING HOT-ISOSTATIC PRESSURE VESSELS

It is well known to produce various alloy articles, such as high speed steel articles and titanium or superalloy articles, by compacting alloy powder charges in a hot isostatic pressing vessel, commonly termed an autoclave, to achieve articles with densities of substantially 100% of theoretical density. Since autoclaves are of expensive construction and operation, it is advantageous from the standpoint of providing an economical manufacturing practice to provide for rapid pressing cycles. This facilitates increased autoclave production rates, thereby lowering the cost per cycle of the product produced thereby.

Most hot isostatic pressing vessels embody a piston or diaphragm gas compressor. Systems of this type have relatively small capacities for pressurization of the vessel and thus require a plurality of gas compressors to achieve pressure levels adequate for hot-isostatic compacting. With vessels of relatively increasing size, coupled with the desire for more rapid pressurization of the vessel and shorter compacting cycles, the piston and diaphragm gas compressors conventionally used for the purpose have become increasingly more disadvantageous from the economic standpoint.

It is consequently desirable to utilize a more rapid pressurization system, and for this purpose cryogenic liquid argon pumps discharging into a vaporizer to produce argon gas at the high pressures required for hot isostatic compacting have been considered for the purpose. These systems convert cryogenic liquid argon, which is at a relatively low pressure, into a gas at a pressure of for example 20,000 psi. This gas, which is discharged from a vaporizer, is introduced into the autoclave to pressurize the same to pressure levels suitable for hot isostatic compacting. Pressurizing systems of this character, however, have not been used in commercial hot isostatic pressing vessels, because after completion of a compacting cycle the argon gas is discharged from the vessel either to the atmosphere or to a gasstorage vessel for subsequent use unassociated with the autoclave. Consequently, in view of the relatively high expense of obtaining a continuous supply of liquid argon for conversion to high-pressure argon gas, pressurizing systems embodying cryogenic liquid argon pumps and assoicated vaporizers have not been used in association with commercial hot isostatic pressing vessels.

It is accordingly the primary object of the present invention to provide a method and apparatus for pressurizing hot isostatic pressing vessels by the use of cryogenic liquid argon pumps in association with argon vaporizers, whereby upon completion of a compacting cycle the argon gas discharged from the autoclave may be cooled to a temperature sufficient to produce cryogenic liquid argon. This liquid argon is stored for subsequent introduction to a liquid argon pump used in association with an argon vaporizer, whereby the stored liquid argon is converted to a gas at pressures sufficient for hot isostatic compacting. In this manner, a closed system is provided, and the argon is reused during each compacting cycle with only minimal argon gas loss.

This and other objects of the invention, as well as a more complete understanding thereof, may be obtained from the following description, specific examples and drawing, in which the single FIGURE thereof is a schematic showing of one embodiment of apparatus in accordance with the practice of the invention.

Broadly the invention involves a hot isostatic compacting system having a gas pressure vessel which is adapted for heating and pressurization to levels sufficient for hot isostatic compacting of for example powder charges of prealloyed high speed steel, titanium base alloys and superalloys. The vessel is pressurized to pressures on the order of for example 10,000 to 20,000 psi by the introduction thereto of argon gas. During compacting the powder charge according to conventional practice is at an elevated temperature. For this purpose heating may be achieved outside the autoclave prior to introducing the charge thereto, within the auto-clave or a combination of both. After compacting, the argon gas is exhausted from the vessel. In accordance with the invention the argon gas so exhausted is collected and stored, preferably in a series of tanks. The gas from these tanks may then be introduced to means for cooling the same to a temperature sufficient to convert the gas to cryogenic liquid argon. Means for achieving liquefaction is a heat exchanger wherein the coolant is liquid nitrogen. The cryogenic liquid argon is stored for further use. When pressurization of the vessel is required for a compacting cycle, the stored liquid argon by means of a cryogenic liquid pump is pumped from storage to increase the pressure thereof and to a vaporizer which converts the pumped cryogenic liquid argon at the increased pressure into a gas at pressure sufficient for use in the vessel for hot isostatic compacting. Accordingly, the gas from the vaporizer is introduced to the vessel for hot isostatic compacting. Upon completion of compacting the argon gas is exhausted from the vessel and stored for recycling, which includes reliquefaction as described.

Stored argon gas is reliquefied by heat exchange with a coolant at a maximum temperature of −303 F at 1 atm and in accordance with the preferred embodiment of this invention the coolant employed is liquid nitrogen, which is typically at a temperature of −321° F at 1 atm. The liquid argon is pumped by the use of acryogenic liquid pump to increase the pressure thereof to a selected level. This liquid argon, at said increased pressure level, is introduced to a vaporizer operated at a temperature sufficient to heat said liquid argon to a temperature within the range of 72° to 120° F to vaporize the same thereby further increasing the pressure of the argon. These vaporization temperatures are sufficient to achieve argon gas at a pressure within the range of 5000 to 30,000 psi and more typically 10,000 to 20,000 psi.

To facilitate transfer of the stored argon gas from the vessel to the heat exchanger for reliquefaction, it is preferred to store the gas in a plurality of gas-storage tanks connected in parallel with each tank being at a relatively lower pressure then the preceding tank. In this manner, the pressure of the gas upon exhausting of the vessel may be retained during storage and used in transmitting the gas from storage to the heat exchanger for liquefaction. In this regard during transfer to the heat exchanger the gas would be preferably removed from the highest pressure tank initially and then progress sequentially to the relatively lower pressure tanks. During this transmittal of the gas from storage to the heat exchanger for liquefaction, it is preferred that the pressure of the gas, prior to reaching the heat exchanger, be decreased to promote subsequent liquefaction. Specifically the gas pressure could be decreased from a storage pressure of about 2000 to 2500 psi to a pressure of about 35 psi.

With respect to the single FIGURE of the drawing, there is shown schematically an embodiment of apparatus suitable for the practice of the present invention. The apparatus includes an autoclave or gas pressure hot isostatic vessel 10 having a top opening 12 therein to permit loading and unloading of a workpiece (not shown) typically in the form of a powder metallurgy charge for compacting. The opening 12 may be selectively opened and sealed by a closure 14 transported by an overhead carriage 16. A crane (not shown) may be used for loading and unloading of the workpiece. The vessel 10 may contain heating means (not shown) for heating the workpiece upon introduction to the vessel. Also associated with vessel 10 is an air discharge line 18 having a valve 20 and vacuum pump 22. The vessel also has an argon-gas discharge line 24 and associated valve 26. Likewise vessel 10 has line 28 and associated pressure relief valve 30. Argon line 32 connects the vessel 10 with a series of argon gas storage tanks 34A, 34B and 34C. Line 32 has associated filters 36 and 38, valve 40 and pressure transducers 42 and 44, with pressure transducer 42 being located downstream of valve 40 and pressure transducer 44 being located upstream of valve 40. Line 32 also contains a pressure transducer 46 in association with argon storage tanks 34 and valves 48A, 48B and 48C. A relief valve 50 is provided at the downstream end of line 32. An argon gas line 52 connects the argon gas storage tanks 34 with heat exchanger 54. In line 52 between the gas storage tanks and the heat exchanger 54 is a valve 56. The heat exchanger 54 has a liquid nitrogen line 58 with associated valves 60 and 61 at the entry, which if fed by a liquid nitrogen source (not shown), and exit ends, respectively, of the heat exchanger 54. From the argon exit end of the heat exchanger 54 there is a liquid argon line 62 connecting the heat exchanger and providing for liquid argon transfer from the heat exchanger to a liquid argon storage tank 64. The line 62 has a valve 66 operated by a liquid argon level control potentiometer 68 adapted to control the valve in accordance with the level of the liquid argon exiting from the heat exchanger 54. From the exit or discharge from liquid argon to storage tank 64 there is a line 70 for transmittal of liquid argon from storage tank 64 to a cryogenic liquid argon pump 72, associated argon vaporizer 74 and the vessel 10. In association with liquid argon line 70 there is a valve 76 at the discharge from the liquid storage tank 64, a subcooler 78, pressure transducer 80, temperature transducer 82 and valve 84, which is adjacent the argon gas entry to the vessel 10.

In the conventional manner a powder metal charge for compacting (not shown) is loaded into the vessel 10 through top opening 12 by means of overhead crane (not shown). Thereupon the carriage 16 moves closure 14 into sealing engagement with opening 12. Air is removed from the vessel via line 18 by opening valve 20 and operating pump 22. Valve 20 is closed upon completion of air removal. The powder metal charge is heated to an elevated temperature suitable for hot isostatic compacting. The powder metal charge is compacted while at said temperature by the introduction of argon gas to the vessel 10, which sequence is well known in the art.

After compacting, if there is heating means within the autoclave such is shut off and the pressure in the autoclave begins to drop. Typically when the autoclave temperature reaches about 500° F, the valve 40 in line 32 is opened to permit the argon gas to be transmitted from the vessel 10 to argon gas storage tanks 34. The gas is introduced to the tanks in sequence beginning with tank 34A and ending with tank 34C. For this purpose associated valve 48A would be opened. Upon the filling of tank 34A associated valve 48A would be closed and valve 48B would be opened to admit argon gas to tank 34B. Relief valve 50 is provided should the pressure within the line 32, such as during opening and closing of valves 48 of gas storage tanks, exceed a selected maximum. pressure transducers 42 and 44 monitor the argon gas pressure at the downstream and upstream sides of valve 40, respectively, and provide an indication of the pressure drop across the valve to permit operation of the valve in a manner suitable to facilitate storage in the tanks 34. If desired, the transducers 42 and 44 may in the well known manner automatically operate valve 40 in response to electrical signals compared to a set point, which signals are proportional to the argon gas pressure at the transducer. Suitable filters 36 and 38 are provided to remove any foreign material from the gas. Typical gas discharge and reclamation from vessel 10 will begin when the vessel has cooled to a temperature of about 500° F. Likewise, typically at this time the autoclave will be at a pressure of about 7000 to 8000 psi and thus the gas will be transmitted from the autoclave to the gas storage tanks 34 which will be typically at a pressure of about 200 psi. By sequentially storing the argon gas, the tank 34A, which is the first tank to be filled, will be at a typical pressure of 2300 psi. The second tank 34B typically will be at a pressure of about 1000 to 1200 psi and the final tank 34C typically will be at a pressure of about 200 to 300 psi. When the argon gas pressure in the vessel 10 reaches about 200 or 300 psi, the valve 40 is closed as are the valves 48 to the argon gas storage tanks 34. Valve 26 in line 24 is opened to discharge the remainder of the gas to the atmosphere via line 24. Upon the completion of this operation the valve 26 is again closed.

In accordance with the invention reliquefaction of the stored argon gas is achieved in the following manner. Valve 48A associated with argon gas storage tank 34A is opened as is valve 56 in line 52. Accordingly, argon gas from tank 34A is transmitted through the cryogenic heat exchanger 54 (typically of aluminum plate fin construction) via line 52. Simultaneously valves 60 and 61 in liquid nitrogen line 58 are opened. Accordingly, the argon gas, after initial cooling resulting from pressure drop across valve 56, passes through the heat exchanger and is cooled by heat exchanger with countercurrent flow of liquid nitrogen at a temperature of about −305° F, whereupon the argon gas is liquified so that at line 62 at the argon exit end of the heat exchanger 54 cryogenic liquid argon is produced. The temperature range at which argon is in the liquid state is relatively narrow ranging from −308° F to −302° F at 1 atm. Hence, it is desirable to control the pressure of the liquid nitrogen flow through the heat exchanger 54 to prevent lowering the temperature of the argon during heat exchange to the freezing point typically −308° F at 1 atm. Valve 66 in line 62 in responce to the output signal of the liquid level control potentiometer mounted on the side of the liquid control vessel 68 maintains a predetermined amount of liquid argon in the control vessel to insure a steady flow to the liquid storage tank 64. The valve 66 is operated to insure a positive pressure and flow from the heat exchanger to the liquid argon storage tank 64. Liquid argon is stored in tank 64 for subsequent used in converting the liquid argon at a relatively low pressure into a gas at high pressure suitable for effecting hot isostatic compacting in vessel 10.

Prior to the introduction of high-pressure argon gas to the vessel 10, the workpiece is introduced thereto and the vessel is sealed in the manner earlier described. After sealing of the vessel air is removed therefrom via line 18 by opening valve 20 and pumping the air from the vessel to the atmosphere by pump 22. After removal of all air from the vessel pumping is discontinued and valve 20 is closed.

To begin pressurization of vessel 10 valve 76 in line 70 is opened to permit liquid argon flow from storage tank 64 through subcooler 78 to the cryogenic liquid argon pump 72. Subcooler 78 is provided to improve the efficiency of pump 72. The vaporizer 74 converts the cryogenic liquid argon at a temperature typically at −303° F to argon gas at a pressure on the order of 10,000 to 20,000 psi and at a temperature within the range of 72° to 120° F. The pressure level of the gas discharged from the vaporizer 74 will depend upon the pressure of the liquid argon entering the vaporizer from the pump and the vaporizer operating temperature. With the valve 84 being open the argon gas from the vaporizer 74 enters the vessel 10 to increase the pressure therein. The pressure and temperature of the gas from the vaporizer is monitored by transducer 80 and transducer 82, respectively. Relief valve 30 in line 28 is provided to permit pressure relief should the gas pressure within the vessel 10 exceed a selected maximum for safe operation. As the argon gas from the vaporizer 74 enters the vessel 10 the pressure therein is increased to a level sufficient to achieve hot isostatic compacting of the heated powder metallurgy charge within the vessel. Upon completion of achieving desired compacting pressure the valve 76 is closed to stop liquid argon flow from the storage tank 64 via pump 72 to the vaporizer, and the operation of the pump is discontinued. Valve 84 is closed and the pressure and temperature within the vessel 10 are permitted to remain a specific time to complete compacting of the powder metallurgy charge. After the specified time the heater (not shown) within the vessel 10 is turned off and the pressure and temperature decreased. The sequence with regard to argon gas reclamation and storage from the vessel, as earlier described, is then started.

Argon gas is necessary in the present invention for purposes of pressurization in that its temperature in the liquid state relative to the liquid nitrogen is such to permit reliquefaction of argon gas by heat exchange with liquid nitrogen. For this purpose the temperatures are typically −321° F at 1 atm for liquid nitrogen and −303° F at 1 atm. for liquid argon. In adition, liquid nitrogen is readily available for use as coolant in the heat exchanger because of both its abundance in the atmosphere and its being a by-product in the commercial production of both argon and oxygen gases.

As a specific example of the practice of the invention employing apparatus similar to that shown in the FIG. of the drawing typical, specific conditions of pressure, temperature and liquid and gas flow volumes would be as follows:

Argon gas is stored in the gas storage tanks 34 at typical pressures of 2300 psi in tank 34A, 1500 psi in tank 34B, and 300 psi in tank 34C. To start the reliquefaction of the argon gas stored in the gas storage tanks 34, valve 48A is opened and argon gas at 2300 psi flows into line 52. Valve 56 in line 52 is then opened to allow the argon gas to flow into the cryogenic plate fin heat exchanger 54 at a typical pressure of 35 psi. Simultaneously with the opening of valve 56, valves 60 and 61 in line 58 are opened to allow the countercurrent flow of liquid nitrogen through the cryogenic plate fin heat exchanger 54. Because of the narrow temperature range of argon liquid −308° to −302° F at 1 atm, the liquid nitrogen −321° F at 1 atm is pressure-controlled as it enters through valve 60, raising its boiling point to preclude freezing of the argon in the heat exchanger. Nitrogen gas is vented out valve 61 after extracting all possible refrigeration from the nitrogen liquid and the cold nitrogen gas. The argon liquefied and subcooled in the cryogenic heat exchanger 54 passes into line 62 where it is collected in the liquid control vessel 68 which regulates its flow into the argon liquid storage tank 64. The liquid argon is stored at a typical pressure of 30 to 40 psi in the storage tank 64. Argon gas from tanks 34A and 34B is taken down to a typical pressure of 1000 psi before stopping the reliquefaction process. At that time, valves 48A and 48B are closed along with valve 58. Simultaneously, the valve 60 in the liquid nitrogen line 58 is closed. When the liquid nitrogen and nitrogen gas have been bled from the cryogenic heat exchanger 54, valve 61 in line 58 is closed.

To perform the hot isostatic pressing operation, the following steps are taken. After loading the vessel 10 and sealing it with the closure 14, the vessel 10 is flushed with argon gas. This is accomplished by opening valve 48C on tank 34C allowing argon gas to flow into line 32. Valve 40 is now opened to allow argon gas to flow into the vessel 10 for typically 2 minutes, at which time valve 40 is closed and valve 26 in line 24 is opened until the vesel 10 pressure is typically 2 psi. The remaining air and argon gas is removed from the vessel 10 by turning on vacuum pump 22 then opening valve 20. After pumping the vessel 10 down to typically 1000 microns, the valve 20 is closed and the vacuum pump 22 turned off.

The vessel 10 is then pressurized with argon gas by opening valve 40 in line 32 until it is equalized with tank 34C pressure typically 100 psi. At this time, internal heating of the vessel 10 is started in a conventional manner utilizing an internal furnace (not shown). Valve 48C is then closed and valves 48A and 48B are opened to equalize the pressure in the vessel 10 with storage tanks 34A and 34B typically at 600 psi. At that time, valves 48A, 48B and 40 are closed isolating the vessel 10.

The pressure is then increased in the liquid argon storage tank 64 to typically 100 psi. Valve 76 is then opened to allow liquid argon to flow from the liquid argon storage tank 64 into and through the subcooler 78 into line 70. The subcooler cools the liquid argon by means of a boiling bath of cryogenic liquid. The boiling bath liquid can be either liquid nitrogen or liquid argon from the storage tank 64. If liquid nitrogen is used, the gas is vented to the atmosphere; if liquid argon is used the argon gas is returned to the strorage tank 64. The boiling liquid absorbs its heat of vaporization from the liquid argon being subcooled, reducing its temperature. This cooling is desired to insure a sufficient net position suction head to the pump to prevent boiling and resulting in cavitation in the pump when the additional heat energy from the pump is absorbed by the process stream.

Pump 72 and the vaporizer unit 74 are comprised of conventionally several direct electric heating modules typically capable of 150 kw total input. These modules typically consist of the liquid argon coils in a solid block which also contains the heater elements. The subcooled liquid argon enters the pump 72 at a rate of 5.4 gpm and pressure of 50 psi typically where its pressure is raised to typically 50 to ~15,000 psi. The pump 72 discharges the liquid argon into the vaporizer unit 74 where it is heated and vaporized. The argon gas discharged from the vaporizer 74 is typically from 50 to 15,000 psi and at a temperature range from 70° to 130° F with a flow rate of 600 scfm.

As the vaporizer discharged argon gas pressure reaches that of the vessel 10, which is typically at 600 psi, as measured by the pressure transducer 80, valve 84 is opened. The vessel 10 is then pumped to a working pressure of 15,000 psi typically with the furnace hot zone being at a typical temperature of 2200° F. The time typically required to reach 15,000 psi in a vessel typically 5 feet ID × 14 feet IL containing a furnace hot zone at 2200° F of 4 feet ID × 10 feet IL would be 1 ½ to 4 hours.

When the desired vessel 10 pressure is reached, typically 15,000 psi valve 84 is closed and simultaneously pumping is stopped by closing valve 76, and shutting down the subcooler 78, pump 72 and vaporizer 74.

After the compacting cycle time, typically in the range of 3 to 6 hours, the power to the furnace is turned off and the power metal charge allowed to cool. Typically in 4 hours in the vessel 10 described above, the load temperature would be 1000° F and the pressure 9000 psi. At this time, reclaim of the argon gas within the vessel is initiated by opening valves 40 and 48A. When tank 34A reaches 2300 psi, valve 48A is closed and valve 48B is opened until the pressure in the vessel 10 and tank 34B equalized at a typical pressure of 1500 psi. At this time, valve 48B is closed and valve 48c is opened until the pressure in the vessel 10 and tank 34c equalizes at a typical pressure of 300 psi. Valves 48c and 40 are then closed and valve 26 opened to exhaust the remaining 300 psi of argon gas within the vessel 10 out through lines 24 to the atmosphere. When the vessel 10 pressure reaches atmospheric, valve 26 is closed and the closure 14 is removed. Unloading of the vessel 10 is accomplished in a conventional manner.

It is understood that the temperature limits recited herein for argon and nitrogen are for operation at a pressure of 1 atmosphere, and that these recited temperatures will change in accordance with changes in pressure.

I claim:

1. In a method for hot-isostatic compacting wherein a gas-pressure vessel is heated and pressurized to levels sufficient for said compacting including the steps of pressurizing said autoclave by the introduction thereto of argon gas to achieve said compacting and exhausting said argon gas from said vessel after compacting, the improvement comprising collecting and storing at least a portion of said argon gas exhausted from said vessel, cooling a portion of said collected and stored argon gas to liquefy said gas to produce liquid argon, pumping said liquid argon to increase the pressure level thereof, and vaporizing said pumped liquid argon to produce argon gas at a further increased pressure level sufficient for said introduction to said vessel to achieve said hot-isostatic compacting.

2. The method of claim 1 wherein said collected and stored argon gas is liquefied by heat-exchange with a coolant within the temperature range of −308° F to −303° F.

3. The method of claim 2 wherein said coolant is liquid nitrogen.

4. The method of claim 3 wherein said liquefied argon is vaporized at a temperature within the range of 72° to 120° F.

5. The method of claim 4 wherein separate quantities of said collected argon gas are stored at a plurality of pressures.

6. The method of claim 5 wherein cooling to liquefy said stored argon gas is performed sequentially beginning with a relatively higher pressure quantity and progressing to a relatively lower pressure quantity of said stored argon gas.

7. The method of claim 2 wherein the pressure of said gas is decreased prior to said liquefying thereof by said heat-exchange.

8. The method of claim 4 wherein said liquefied argon is stored in the liquid state prior to said vaporization.

9. In a method for hot-isostatic compacting wherein a gas-pressure vessel is heated and pressurized to levels sufficient for said compacting including the steps of pressurizing said autoclave by the introduction thereto of argon gas to achieve said compacting and exhausting said gas from said vessel after compacting, the improvement comprising collecting and storing at least a portion of said argon gas exhausted from said vessel, cooling a portion of said collected and stored argon gas by heat exchange with liquid nitrogen to liquefy said argon gas to produce liquid argon, storing said liquid argon, pumping said liquid argon to increase the pressure level thereof, vaporizing a portion of said pumped liquid argon to produce argon gas at a further increased pressure level sufficient for said introduction to said vessel to achieve said hot-isostatic compacting.

10. In a gas pressure apparatus for hot-isostatic compacting including a high-pressure working chamber adapted to support therein a workpiece for hot-isostatic compacting, means for selectively opening and sealing said chamber for loading and removal of said workpiece, means for heating a workpiece within said chamber, means for introducing argon gas to said chamber and means for exhausting argon gas from said chamber, the improvement comprising means for collecting and storing argon gas exhausted from said working chamber, means for cooling and thereby liquefying argon gas from said collecting and storing means to produce liquid argon, means for increasing the pressure of said liquid argon, means for vaporizing said liquid argon to produce argon gas at a pressure sufficient for hot isostatic compacting of a workpiece within said chamber upon introduction of said gas thereto.

11. The apparatus of claim 10 wherein said means for increasing the pressure of said liquid argon is a cryogenic liquid pump.

12. The apparatus of claim 10 having means for storing said liquid argon prior to said vaporizing thereof.

13. The apparatus of claim 12 having a plurality of collecting and storage tanks for collecting and storing said argon gas exhausted from said working chamber at differential pressure levels.

14. The apparatus of claim 13 having means for decreasing the pressure of argon gas prior to introduction of said gas to said cooling and liquefying means.

* * * * *